US007101081B2

(12) United States Patent
Chen et al.

(10) Patent No.: US 7,101,081 B2
(45) Date of Patent: Sep. 5, 2006

(54) POSITIONING DEVICE FOR A BALL BEARING SLIDE

(75) Inventors: Ken-Ching Chen, Kaohsiung Hsien (TW); Shih-Long Hwang, Kaohsiung Hsien (TW); Shun-Ho Yang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 144 days.

(21) Appl. No.: 10/960,956

(22) Filed: Oct. 12, 2004

(65) Prior Publication Data

US 2006/0078235 A1 Apr. 13, 2006

(51) Int. Cl.
*A47B 1/10* (2006.01)

(52) U.S. Cl. ..... 384/21; 312/334.46

(58) Field of Classification Search ..... 384/18, 384/19, 21; 312/333, 334.44, 334.46, 334.47, 312/334.7

See application file for complete search history.

(56) References Cited

U.S. PATENT DOCUMENTS

| | | | | |
|---|---|---|---|---|
| 4,549,773 | A | 10/1985 | Papp et al. | |
| 5,255,983 | A | 10/1993 | Parvin | |
| 5,542,759 | A | 8/1996 | Krivec | |
| 5,577,821 | A * | 11/1996 | Chu | 384/21 |
| 5,730,514 | A | 3/1998 | Hashemi | |
| 6,367,899 | B1 * | 4/2002 | Hwang et al. | 312/334.47 |
| 6,502,910 | B1 | 1/2003 | Kuo-Chan | |
| 6,851,774 | B1 * | 2/2005 | Chen et al. | 312/334.47 |

* cited by examiner

*Primary Examiner*—Thomas R. Hannon
(74) *Attorney, Agent, or Firm*—Rosenberg, Klein & Lee

(57) ABSTRACT

A positioning device for a ball bearing slide includes a positioning member and a releasing member and is incorporated with a mobile track and a fixed track. The positioning member is pivoted to the mobile track. The releasing member is inserted into the mobile track. The positioning member includes a resilient lever having a taper block to hold against the fixed track to restrict the mobile track in both directions. The positioning member further includes a protruding post. The releasing member is provided with a hollowed trough to link to the positioning member to release the bi-way restriction.

12 Claims, 8 Drawing Sheets

POSITIONING DEVICE FOR A BALL BEARING SLIDE

BACKGROUND OF THE INVENTION (a) Field of the Invention

The present invention is a positioning device for a ball bearing slide, and more particularly to one that exercises bi-way restriction to prevent a mobile track from retracting and falling out of position when it is pulled out in relation to a fixed track, and is provided with a releasing member to release the restriction or to remove the mobile track.

(b) Description of the Prior Art

The prior art as taught in U.S. Pat. Nos. 4,549,773, 5,255,983, 5,542.759, 5,730,514, and 6,502,910 discloses a retainer to directly hold a mobile track from falling out of a fixed track when the mobile track is pulled outwardly while by directly operating the retainer, the mobile track is released from the fixed track. However, the operation requirements of a ball bearing slide is not limited to retaining or releasing of the mobile track, further operations of preventing the mobile track from being retracted and later having the mobile track to retract after its positioning status is released may be considered and solved.

SUMMARY OF THE INVENTION

The primary purpose of the present invention is to provide a positioning device for a ball bearing slide that restricts a mobile track from being easily retracted and falling out of a fixed track by means of a positioning member, and later releases the mobile track or removes its from the fixed track by means of a releasing member. To achieve the purpose, the positioning member is pivoted to the mobile track, and the releasing member is slid into the mobile track. The positioning member is provided with a resilient lever and a retaining foot. A taper block is formed on one end of the resilient lever. A protruding post is disposed to the retaining foot. A hollowed trough is provided to the releasing member for the protruding post to insert into. The hollowed trough has a bevel edge in relation to the protruding post. A retaining block and a retaining wall are provided to a stopper of the fixed track with the retaining block located in relation to the resilient lever and the retaining wall, to the retaining foot. Once the mobile track is pulled externally, it is restricted in both directions by having the taper block of the resilient lever to hold against the retaining block, and the retaining foot to hold against the retaining wall. The mobile track is cleared off the fixed track by operating the releasing member to disengage the retaining foot from the retaining wall.

DETAILED DESCRIPTION OF THE PREFERRED EMBODIMENTS

Figure 1:
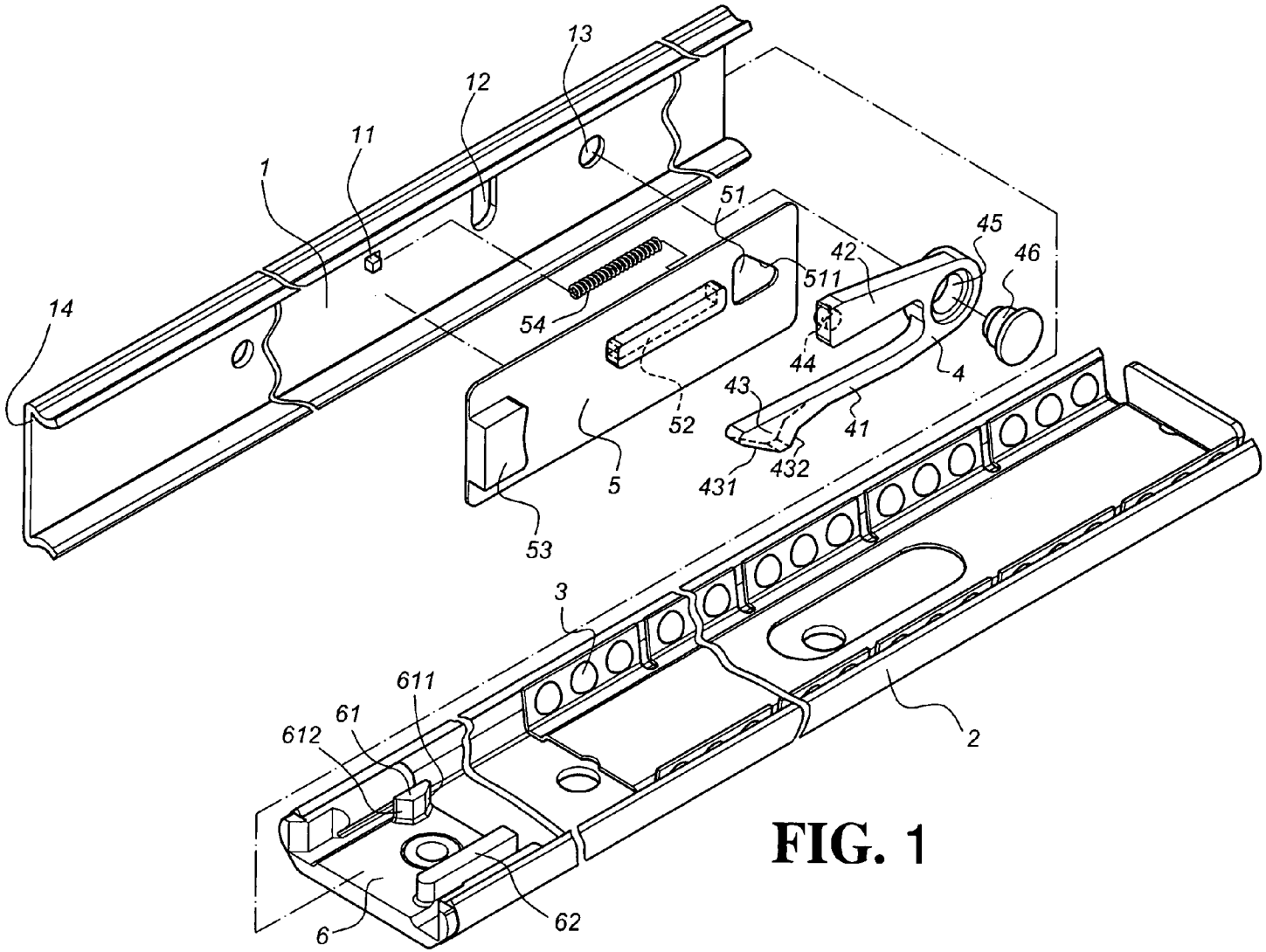
FIG. 1 is an exploded view showing a first preferred embodiment of the present invention.
Figure 2:
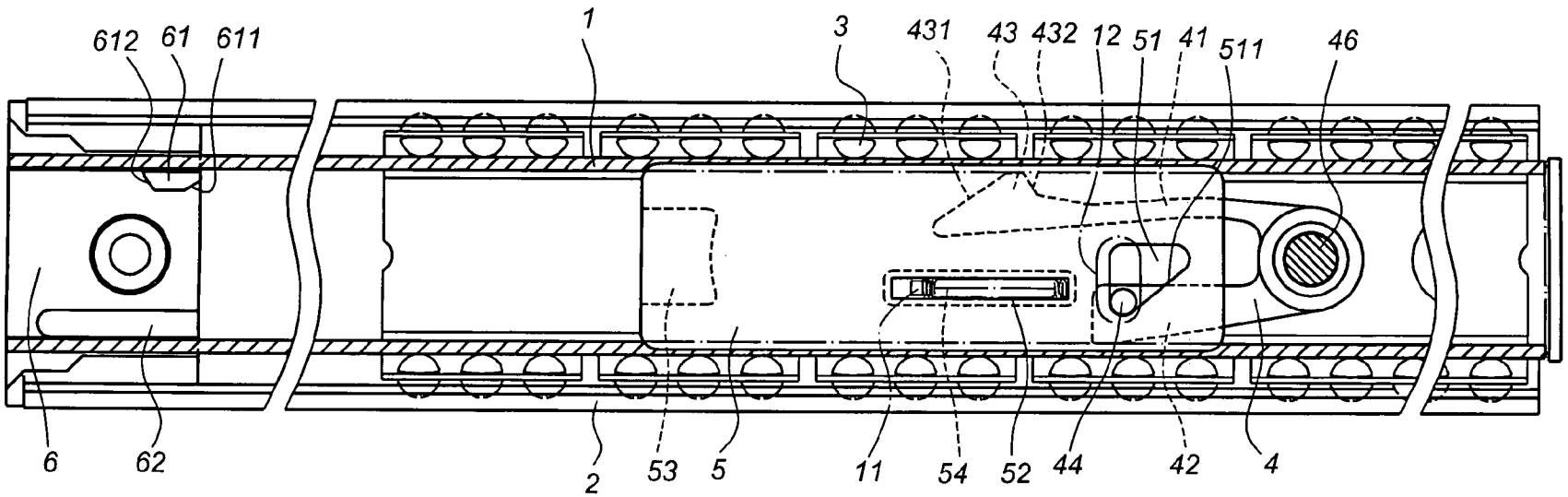
FIG. 2 is a cross-sectional view showing that the first preferred embodiment of the present invention as an assembly is in a retracted status.

Referring to FIGS. 1 and 2, a first preferred embodiment of the present invention comprises a positioning member (4) and a releasing member (5) adapted with a mobile track (1), a fixed track (2), a ball bearing mechanism (3), and a stopper (6).

The mobile track (1) is provided with a retaining bit (11), a slot (12), a through hole (13) and a pair of slide channels (14).

The ball bearing mechanism (3) is provided in the fixed track (2). The stopper (6) is provided at one end of the fixed track (2).

The positioning member (4) comprises a resilient lever (41), a retaining foot (42), and a through hole (45). The outer end of the resilient lever (41) is formed with a taper block (43). The taper block (43) includes a front bevel edge (431) and a rear bevel edge (432) with the tip between the two bevel edges (431, 432) engaging with the mobile track (1). A protruding post (44) is provided on one side of the outer end of the retaining foot (42). The positioning member (4) is pivoted to the mobile track (1) by means of a bolt (46) penetrating through the through hole (45) and the through hole (13) of the mobile track (1).

The releasing member (5) is a slide plate having provided with a hollowed trough (51). The hollowed trough (51) contains a bevel edge (511). The releasing member (5) is provided with a chamber (52) to accommodate a resilient member (54). One end of the resilient member (54) holds against the interior of the chamber (52) while another end of the resilient member (54) holds against the retaining bit (11) of the mobile track (11). A knob (53) is provided at the outer end of the releasing member (5) to facilitate applying force to push or pull.

The stopper (6) comprises a retaining block (61) and a retaining wall (62). The position of the retaining block (61) is in relation to the resilient lever (41) of the positioning member (4), while the position of the retaining wall (62) is in relation to the retaining foot (42) of the positioning member (4). The retaining block (61) is provided with a first bevel edge (611) and a second bevel edge (612).

The mobile track (1) is inserted into the fixed track (2) and slides along by the rolling motion of the ball bearing mechanism (3). The releasing member (5) is inserted into the mobile track (1) through the slide channels (14). The retaining bit (11) of the mobile track (1) holds against another end of the resilient member (54). The positioning member (4) is pivoted to the mobile track (1) by means of the bolt (46). The protruding post (44) of the positioning member (4) penetrates through the hollowed trough (51) of the releasing member (5) and the slot (12) of the mobile track (1). The hollowed trough (51) holds with its bevel edge (511) against the protruding post (44) for the releasing member (5) to link to the positioning member (4). The linkage between the is releasing member (5) and the positioning member (4) permits automatic return by means of the resilient member (54).

Figure 3:
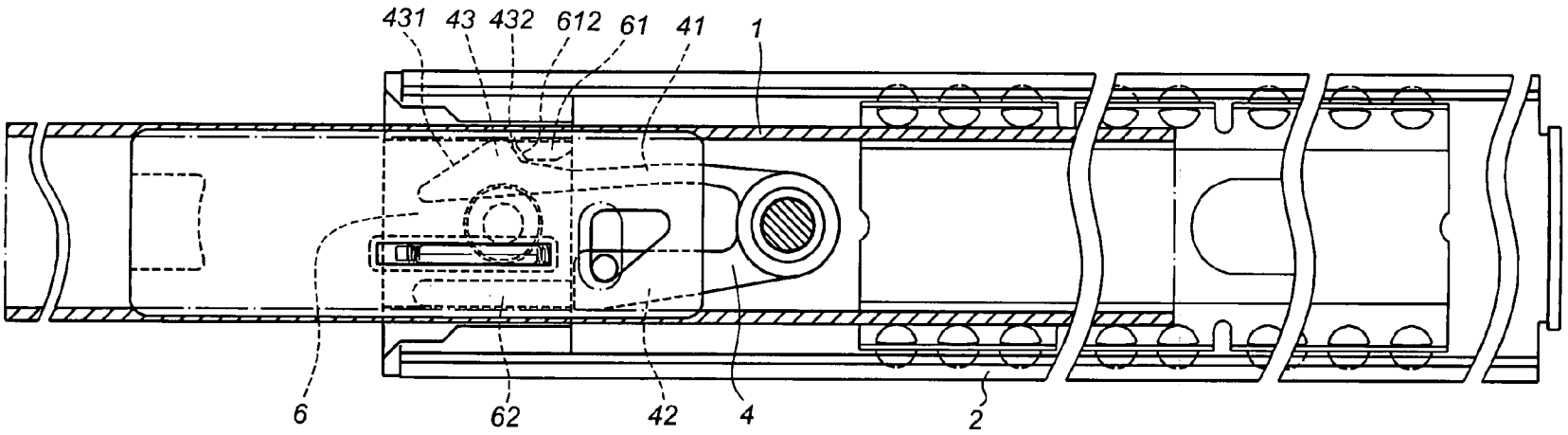
FIG. 3 is a cross-sectional view showing that the first preferred embodiment of the present invention is pulled externally and held in position.

As illustrated in FIG. 3, when the mobile track (1) is pulled out, the retaining foot (42) of the positioning member (4) holds against the retaining wall (62) of the stopper (6) to restrict the mobile track (1) from falling out of the fixed track (2). Meanwhile, the resilient lever (41) of the positioning member (4) provides spring force to have the retaining foot (42) to firmly hold against the retaining wall (62). The taper block (43) of the resilient lever (41) has the front bevel edge (431) sliding over the retaining block (61) of the stopper (6), and then has the rear bevel edge (432) to hold against the second bevel edge (612) of the retaining block (61) without being easily pushed to retract. Consequently, the mobile track (1) is temporarily held in place in both directions.

Figure 4:
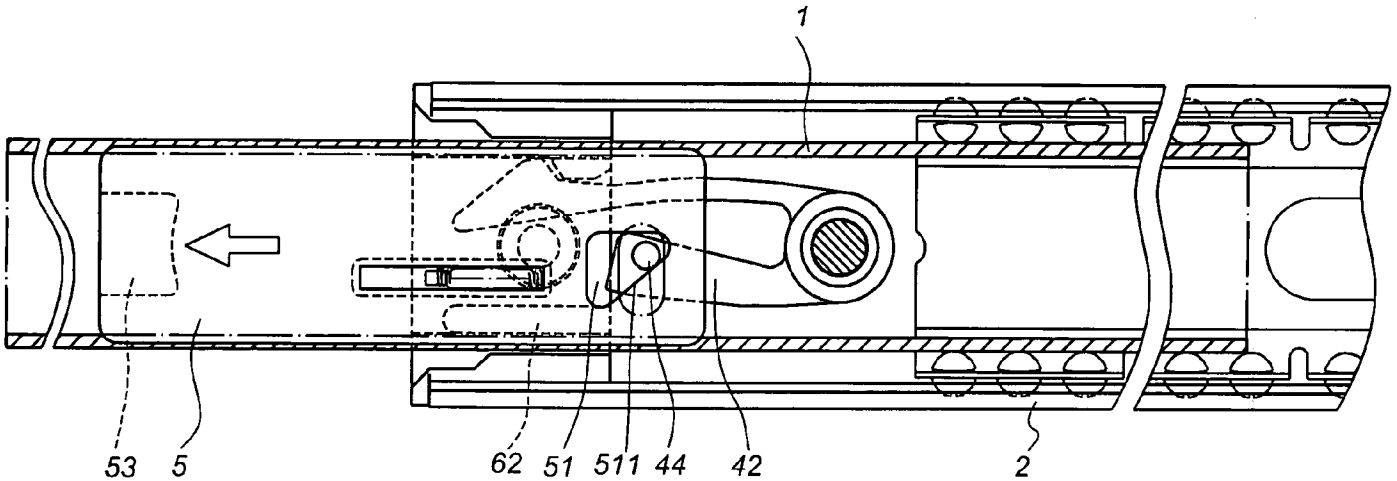
FIG. 4 is a cross-sectional view showing that the first preferred embodiment of the present invention is released from its restriction by the retaining foot.
Figure 5:
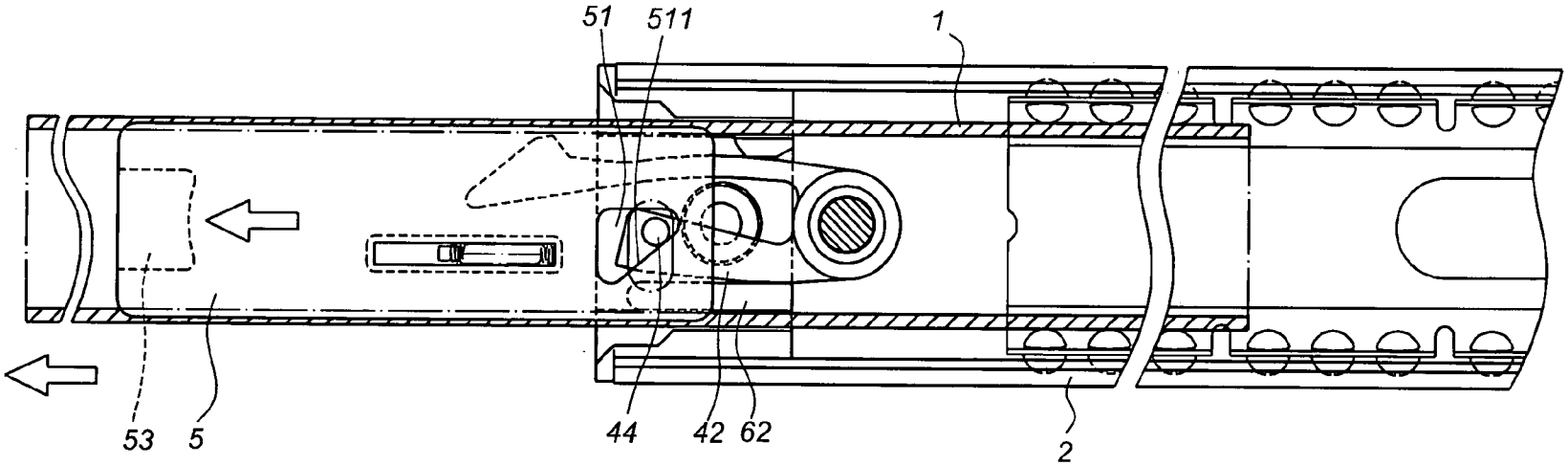
FIG. 5 is a cross-sectional view showing that a mobile track is pulled away after the release from the retaining foot in the first preferred embodiment of the present invention.
Figure 6:
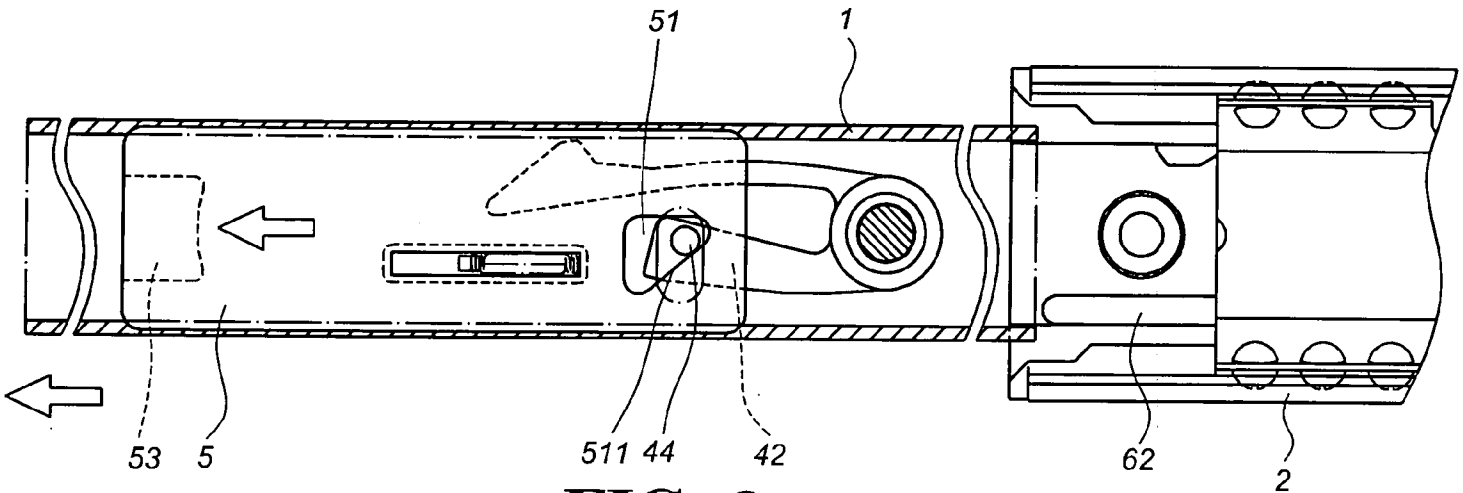
FIG. 6 is another cross-sectional view showing that the mobile track is pulled away after the release from the retaining foot in the first preferred embodiment of the present invention.
Figure 7:
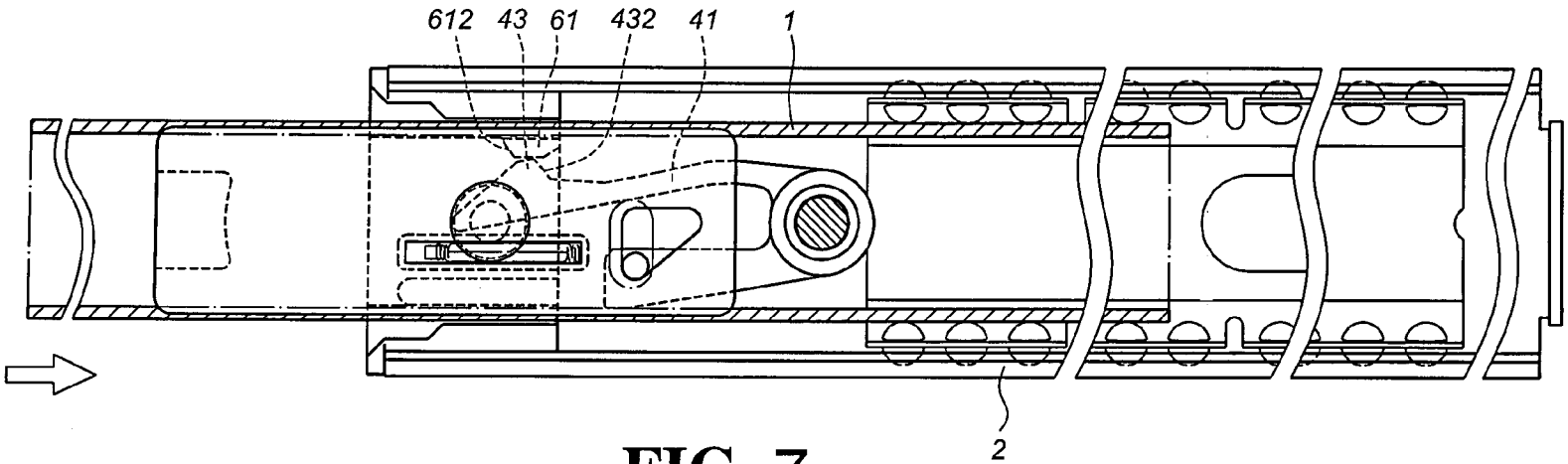
FIG. 7 is a cross-sectional view showing that the mobile track is pushed in by force in the first preferred embodiment of the present invention.
Figure 8:
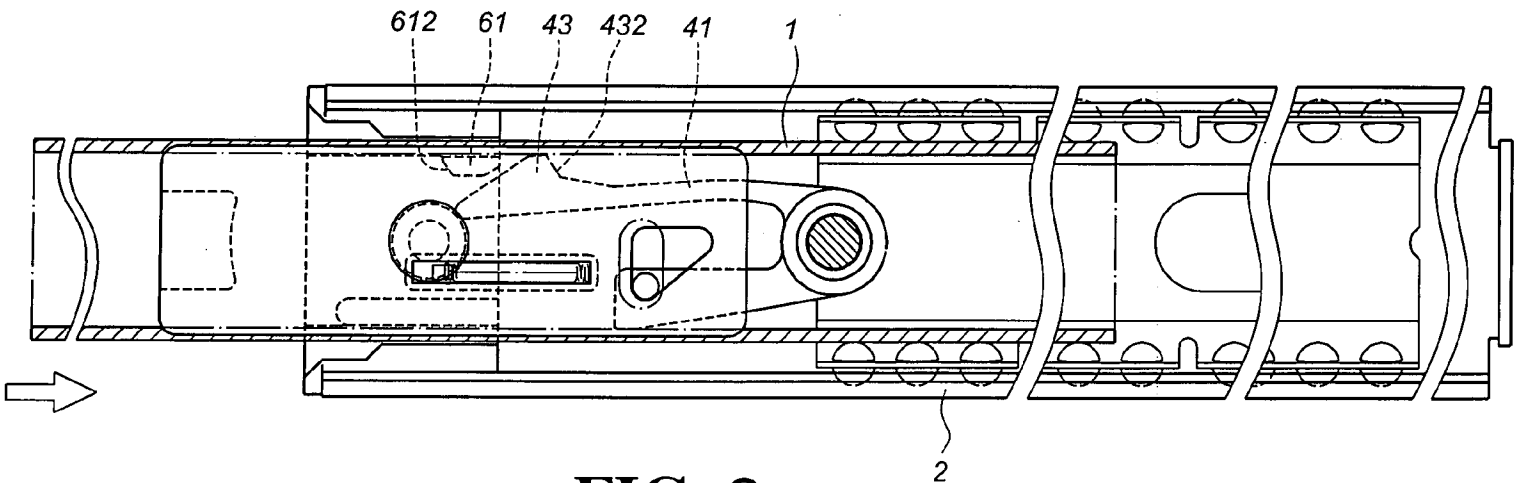
FIG. 8 is another cross-sectional view showing that the mobile track is pushed in by force in the first preferred embodiment of the present invention.

Now referring to FIGS. 4, 5, and 6, when the removal of the mobile track (1) from the fixed track (2) is desired, the knob (53) of the releasing member (5) is pulled for the hollowed trough (51) to have its bevel edge (511) pushing against the protruding post (44) of the retaining foot (42), so that the retaining foot (42) is pushed away from the retaining wall (62) to release its restriction to prevent the mobile track (1) from being outwardly pulled thus to draw the mobile track (1) from the fixed track (2). To retract the mobile track (1) into the fixed track (2) once again, as illustrated in FIGS. 7 and 8, the user applies proper push on the mobile track (1) to flexibly bend the resilient lever (41) for the taper block (43) to pass over the retaining block (61). The mobile track (1) is once again retracted into the fixed track (2).

Figure 9:
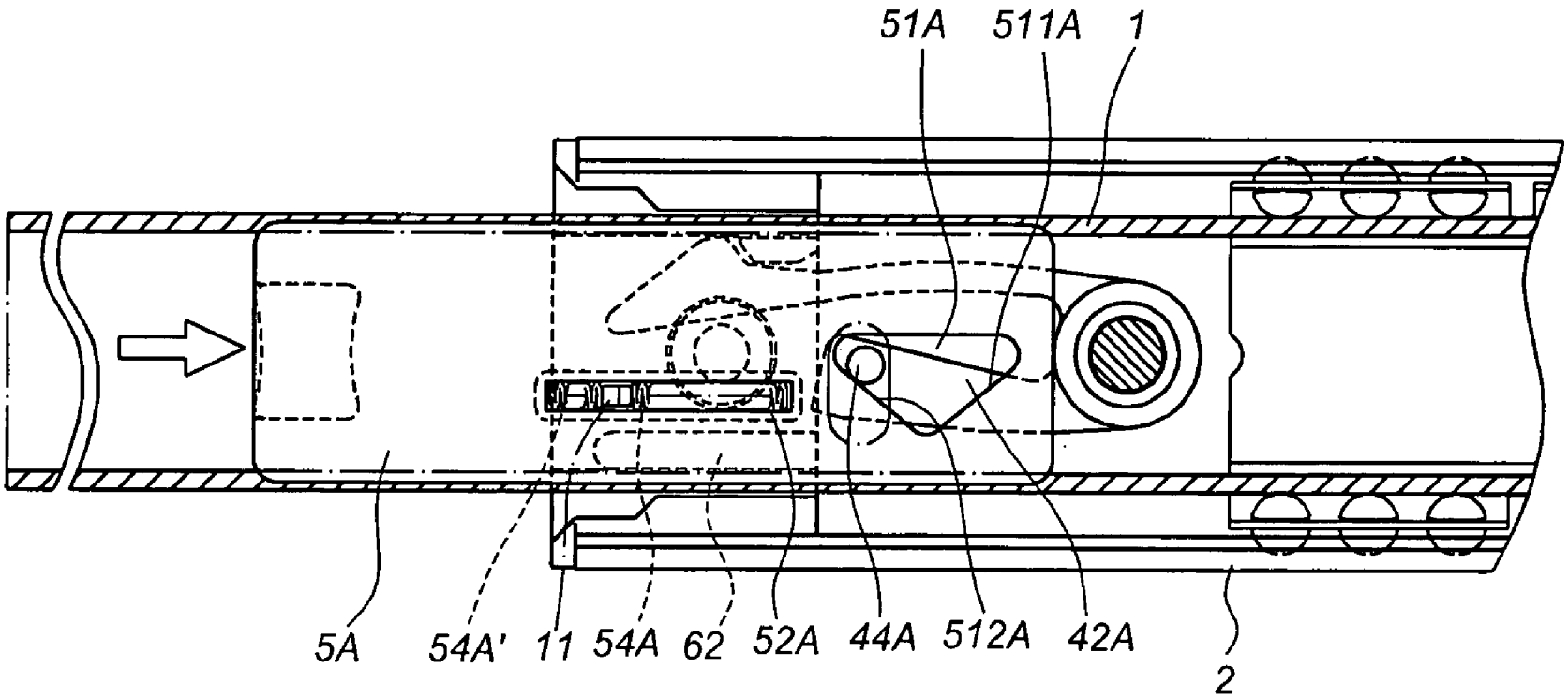
FIG. 9 is a cross-sectional view showing that a bi-way releasing member releases the restriction from a retaining foot in a second preferred embodiment of the present invention.

As illustrated FIG. 9 for a second preferred embodiment of the present invention, a releasing member (5A) is provided to operate in both directions. A larger hollowed trough (51A) compared to that in the first preferred embodiment and an abutted bevel edge (512A) are provided for the releasing member (5A). Accordingly, when the releasing member (5A) is inwardly pushed toward the fixed track (2), a retaining foot (42A) is pushed away from the retaining wall (62) since the bevel edge (512A) pushes against a protruding post (44A) of the retaining foot (42A) thus to release the positioning function of the retaining foot (42A).

To cope with the bi-way operation mode of the releasing member (5A), two resilient members (54A, 54A') are provided in series inside a chamber (52A) of the releasing member (5A) with the retaining bit (11) of the mobile track (1) holding against between the resilient members (54A, 54A') to render spring force in both directions.

Figure 10:
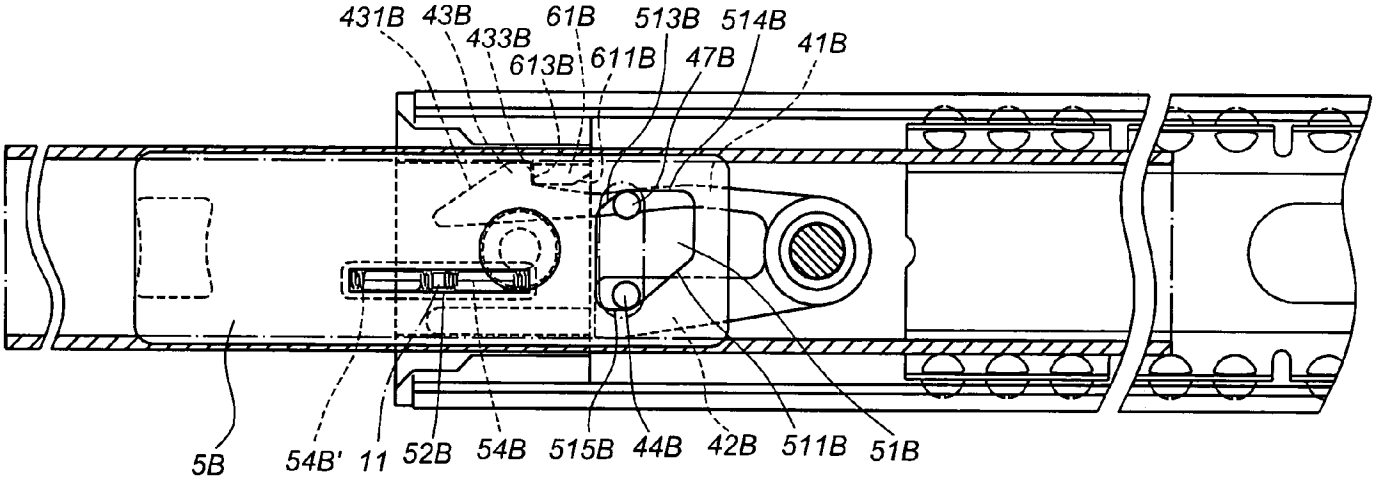
FIG. 10 is a cross-sectional view showing that a releasing member releases the restriction from a resilient lever in a third preferred embodiment of the present invention.

In both of the first and the second preferred embodiments given above, the "forced pushing in" mode is applied in retracting the mobile track (1) into the fixed track (2). Saving such mode of the "forced pushing in", another protruding post (47B) is provided to a resilient lever (41B) to insert into a hollowed trough (51B) of a releasing member (5B) in a third preferred embodiment of the present invention, as illustrated in FIG. 10. A second bevel edge (513B) in relation to the protruding post (47B) is provided in the hollowed trough (51B), a straight edge (514B) is disposed to the second bevel edge (513B) and another straight edge (515B) is disposed to an abutted first bevel edge (511B). When the releasing member (5B) moves in different directions, a protruding post (44B) provided on a retaining foot (42B) and the protruding post (47B) on the resilient lever (41B) will not be subject to the limiting interference from the hollowed trough (51B) due to the presence of both straight edges (514B, 515B). A taper block (43B) is provided with a vertical edge (433B) adjacent to a bevel edge (431B). A retaining block (61B) is provided with a vertical edge (613B) adjacent to a bevel edge (611B). Having both vertical edges (433B, 613B), a positioning status is created that prevents forcing to push in the mobile track (1). In the third preferred embodiment, two resilient members (54B, 54B') are provided in series in a chamber (52B) of the releasing member (5B) while the retaining bit (11) of the mobile track (1) holds against between the resilient members (54B, 54B') to render spring force in both directions.

Figure 11:
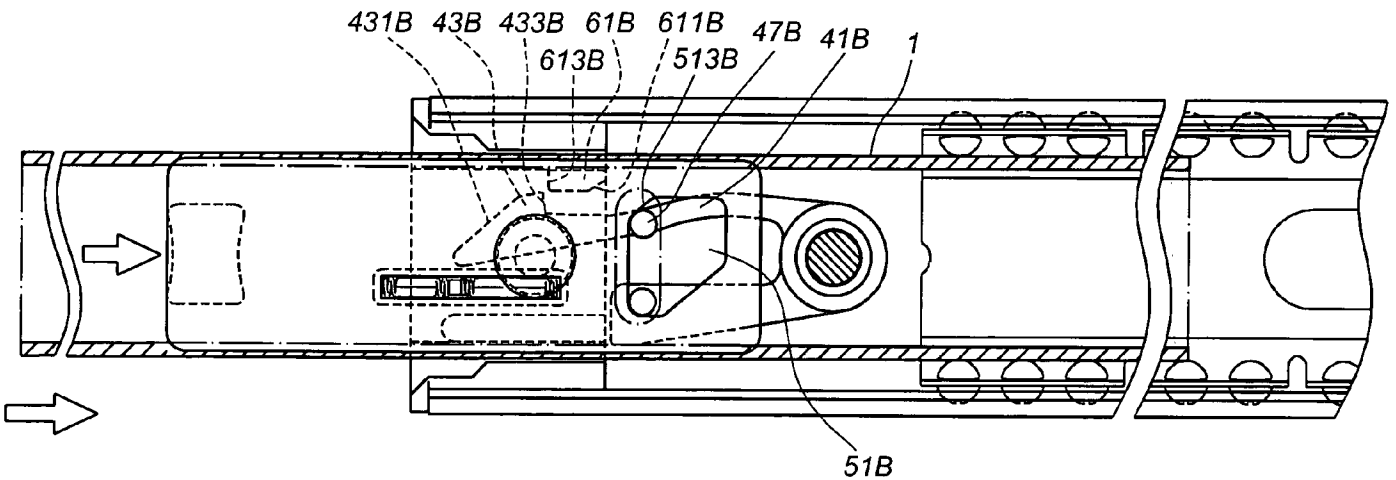
FIG. 11 is another cross-sectional view showing that the releasing member releases the restriction from a resilient lever in the third preferred embodiment of the present invention.

As illustrated in FIG. 11, when the releasing member (5B) is pushed to move, the bevel edge (513B) of the hollowed trough (51B) holds against the protruding post (47B) on the resilient lever (41B) so as to push the taper block (43B) of the resilient lever (41B) away from the retaining block (61B) to release its restriction of moving inwardly by the mobile track (1), and to push the mobile track (1) into the fixed track (2).

Figure 12:
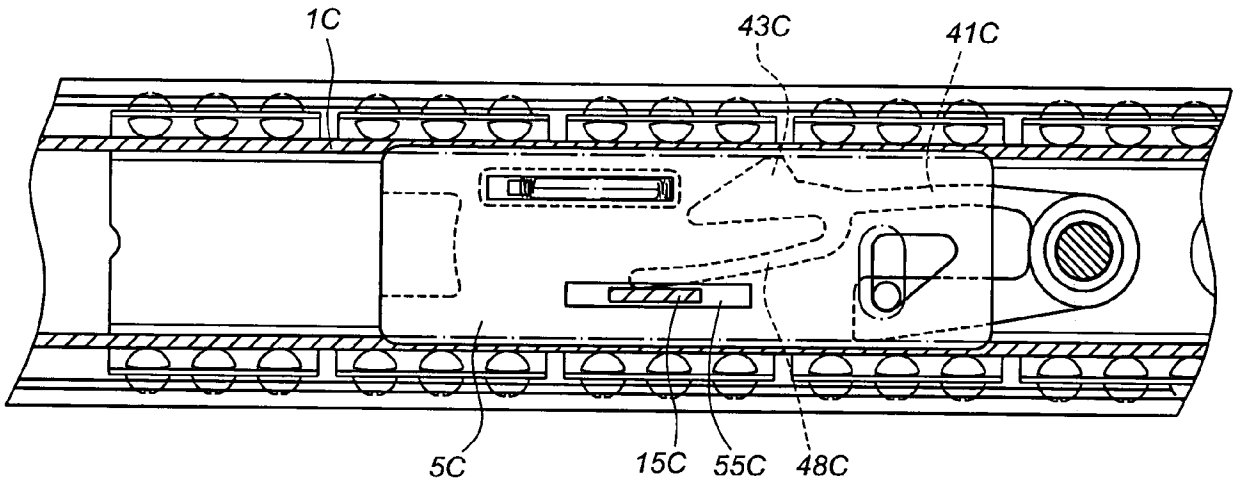
FIG. 12 is a cross-sectional view showing a resilient lever of a positioning member of a fourth preferred embodiment of the present invention.

As illustrated in FIG. 12 for a fourth preferred embodiment of the present invention, a reinforcement design may be provided to a resilient lever (41C) for storage more return force. An extension lever (48C) is formed at an inner end of a taper block (43C) of the resilient lever (41C) with the tail of the extension lever (48C) holding against a stopper (15C) provided on a mobile track (1C). A slot (55C) is provided to a releasing member (5C) for the stopper (15C) to penetrate through. Accordingly, with the improved spring force for the flexible bend of the resilient lever (41C), the operation of positioning or forced push in for the mobile track (1C) becomes more precise.

Figure 13:
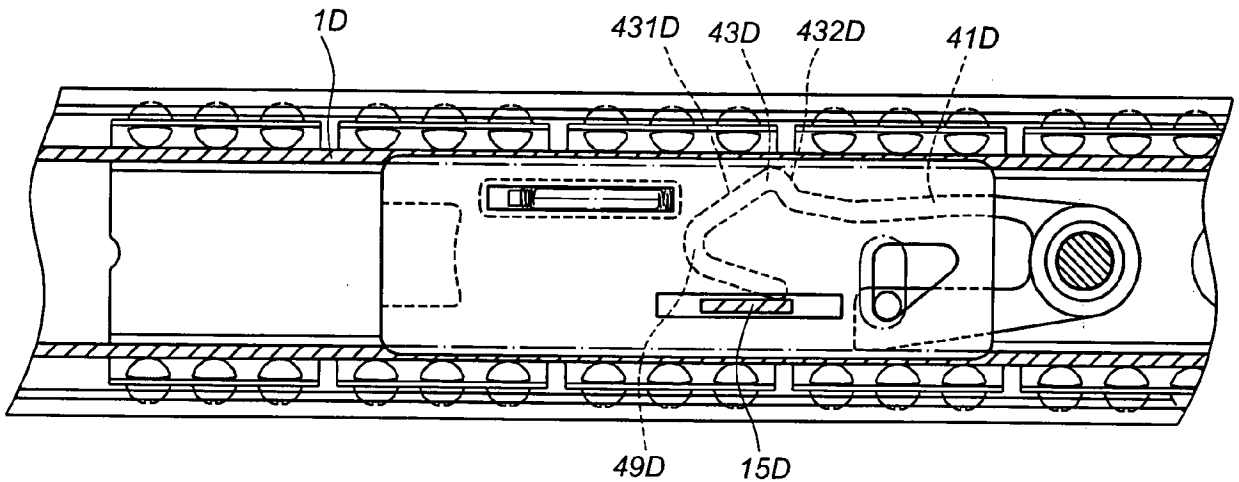
FIG. 13 is a cross-sectional view showing a resilient lever of a positioning member of a fifth preferred embodiment of the present invention.

Furthermore, as illustrated in FIG. 13 for a fifth preferred embodiment of the present invention, an extension lever (49D) functioning similar to the extension lever (48C) in the fourth preferred embodiment extends from the tail of a taper block (43D) of a resilient lever (41D). The tail of the extension lever (49D) holds against a stopper (15D) provided on a mobile track (1D). Other than that, the form of the taper block (43D) of the resilient lever (41D) features bevel curve to compromise the slope of two bevel edges (431D, 432D) to cause the stress status of the resilient lever thereon to be better balanced.

What is claimed is:

1. A positioning device for a ball bearing slide incorporated with a mobile track and a fixed track, wherein the mobile track has slide channels; the mobile track being inserted into the fixed track; the fixed track being provided with a stopper, and characterized in that:

the positioning device comprising a positioning member and a releasing member; the positioning member being provided with a resilient lever and a retaining foot; the resilient lever having one end formed with a taper block; the taper block being provided with a bevel edge; a protruding post being disposed on one side of one end of the retaining foot; the releasing member being a slide plate; the releasing member being provided with a hollowed trough for insertion of the protruding post; the hollowed trough being provided with a bevel edge in relation to the protruding post;

the stopper of the fixed track comprising a retaining block and a retaining wall; the retaining block being provided in relation to the resilient lever of the positioning member; the retaining wall being provided in relation to the retaining foot of the positioning member; the retaining block including a bevel edge;

thereby, the positioning member being pivoted to the mobile track, the releasing member sliding into the slide channels of the mobile track; the taper block sliding over the retaining block and secured in place and the retaining foot holding against the retaining wall when the mobile track is pulled externally to restrict the location of the mobile track in both directions; with the releasing member being pulled out, the retaining foot being free from the retaining wall as driven by the protruding post of the retaining foot relatively by the bevel edge of the hollowed trough of the releasing member.

2. The positioning device for a ball bearing slide of claim 1, wherein the taper block includes another bevel edge abutted to the bevel edge of the taper block.

3. The positioning device for a ball bearing slide of claim 1, wherein the taper block includes a vertical edge abutted to the bevel edge of the taper block.

4. The positioning device for a ball bearing slide of claim 1, wherein the releasing member further includes a resilient member; the resilient member having two ends; the releasing member being provided with a chamber to accommodate the resilient member and hold against one end of the resilient member; and a retaining bit disposed on the mobile track holding against another end of the resilient member.

5. The positioning device for a ball bearing slide of claim 1, wherein the releasing member is provided with a knob.

6. The positioning device for a ball bearing slide of claim 1, wherein a slot in relation to the protruding post is provided on the mobile track for the protruding post to penetrate through.

7. The positioning device for a ball bearing slide of claim 1, wherein the retaining block of the stopper on the fixed track includes another bevel edge abutted to the bevel edge of the retaining block.

8. The positioning device for a ball bearing slide of claim 1, wherein the retaining block of the stopper on the fixed track includes a vertical edge abutted to the bevel edge of the retaining block.

9. The positioning device for a ball bearing slide of claim 1, wherein the hollowed trough of the releasing member includes another bevel edge abutted to the bevel edge of the hollowed trough.

10. The positioning device for a ball bearing slide of claim 1, wherein a second protruding post is provided to the resilient lever to insert into the hollowed trough of the releasing member; a straight edge being provided to the abutted second bevel edge; and a second straight edge being provided to the abutted first bevel edge of the hollowed trough.

11. The positioning device for a ball bearing slide of claim 1, wherein an extension lever is provided to the taper block of the resilient lever to hold against a stopper on the mobile track; and a slot is provided to the releasing member for the stopper of the mobile track to penetrate through.

12. The positioning device for a ball bearing slide of claim 11, wherein the form of the taper block of the resilient lever is a taper curved section to compromise the slope of two bevel edges and a second extension lever is provided to the tail of the taper curved section.

* * * * *